US006773357B2

(12) United States Patent
Tai et al.

(10) Patent No.: US 6,773,357 B2
(45) Date of Patent: Aug. 10, 2004

(54) PUTTING AID FOR AIDING A GOLFER IN PROPERLY ALIGNING THE GOLFER'S LINE OF SIGHT, PUTTING STROKE AND CLUB HEAD ANGLE

(75) Inventors: Woon Shing Tai, Kowloon (HK); Marc Boggia, Happy Valley (HK)

(73) Assignee: Concord Century Int'l Ltd., Hong Kong (HK)

( * ) Notice: Subject to any disclaimer, the term of this patent is extended or adjusted under 35 U.S.C. 154(b) by 0 days.

(21) Appl. No.: 10/084,631

(22) Filed: Feb. 27, 2002

(65) Prior Publication Data

US 2003/0162602 A1 Aug. 28, 2003

(51) Int. Cl.[7] ..... A63B 69/36

(52) U.S. Cl. ..... 473/195; 473/261; 473/268; 473/257

(58) Field of Search ..... 473/195, 257, 473/261, 262, 264, 265, 266, 268, 269

(56) References Cited

U.S. PATENT DOCUMENTS

| | | | | | |
|---|---|---|---|---|---|
| 2,276,141 | A | * | 3/1942 | Atkinson | 211/37 |
| 2,869,875 | A | * | 1/1959 | Steenson | 473/170 |
| 2,885,090 | A | * | 5/1959 | Forman et al. | 211/175 |
| 3,656,752 | A | * | 4/1972 | Moriarty | 473/261 |
| 3,722,702 | A | * | 3/1973 | Marker, Jr. | 211/204 |
| 3,806,133 | A | | 4/1974 | Cork | |
| 3,857,570 | A | | 12/1974 | Gutierrez et al. | |
| 3,888,353 | A | * | 6/1975 | Leifheit | 211/37 |
| 4,129,301 | A | | 12/1978 | Kenney | |
| 4,315,626 | A | | 2/1982 | Hamm | |
| 5,037,100 | A | | 8/1991 | Montgomery, Sr. | |
| D325,419 | S | * | 4/1992 | Mulloy | D21/791 |
| D332,817 | S | * | 1/1993 | Mullen | D21/791 |
| 5,209,484 | A | | 5/1993 | Randall | |
| 5,273,284 | A | * | 12/1993 | Montgomery | 473/258 |
| 5,586,945 | A | | 12/1996 | Vonderhaar | |
| 5,776,007 | A | * | 7/1998 | Kendall et al. | 473/258 |
| 5,897,439 | A | * | 4/1999 | Hohl et al. | 473/176 |
| 5,913,732 | A | | 6/1999 | Kwakkel | |
| 6,048,273 | A | | 4/2000 | Clement | |
| 6,129,639 | A | | 10/2000 | Brock et al. | |
| 6,461,247 | B1 | * | 10/2002 | Riddell | 473/219 |

* cited by examiner

*Primary Examiner*—Stephen P. Garbe
*Assistant Examiner*—Nini F. Legesse
(74) *Attorney, Agent, or Firm*—Christie, Parker & Hale, LLP

(57) ABSTRACT

A putting aid is provided that has a first and a second attachment structure, an upper alignment member disposed between and attached to the attachment structures and a lower alignment member disposed between and attached to the attachment structures, such that the alignment members are vertically aligned to define a vertical plane which is perpendicular to a putting surface. In use, a golf ball is positioned on the putting surface such that a centerline of the golf ball is aligned with the vertical plane, and thus is also aligned with the target line. The golfer then aligns the golfer's line of sight with the vertical plane such that the upper alignment member obscures the lower alignment member, aligns an aim line of a putter such that the alignment members obscure the aim line of the putter and maintains both the alignment of the golfer's line of sight and the alignment of the aim line of the putter during a putting stroke.

19 Claims, 4 Drawing Sheets

PUTTING AID FOR AIDING A GOLFER IN PROPERLY ALIGNING THE GOLFER'S LINE OF SIGHT, PUTTING STROKE AND CLUB HEAD ANGLE

FIELD OF THE INVENTION

This invention relates to a golf putting aid. More particularly, this invention relates to a putting aid which assists a golfer in properly aligning the golfer's line of sight and putting stroke with a target line and aligning a putter club face perpendicular to the target line.

BACKGROUND OF THE INVENTION

As a putting aid, a target line is a path from a golf ball to a golf cup that, if followed, results in the ball landing in the cup. In order to properly envision the target line, it is helpful for a golfer to vertically align the golfer's line of sight with a vertical plane, which is perpendicular to a putting surface and passes through a centerline of the golf ball. If the golfer's line of sight is not aligned in this manner, it is less likely that the golfer will correctly envision the target line, and likely that the golfer will envision a line that does not lead the ball to the cup. If this occurs, and the remainder of the golfer's putting stroke is perfect, the ball will follow the improperly envisioned line, rather than the target line, and not land in the cup. However, even if the golfer properly envisions the target line, the ball can still miss the cup if a club face on the golfer's putter does not travel along the target line during the golfer's putting stroke. In addition, even if the golfer properly envisions the target line and swings the club face of the putter perfectly in line with the target line during the golfer's putting stroke, the ball can still miss the cup if the club face of the putter is not square to the ball when the club face contacts the ball. As a result, in order to develop an accurate and consistent putting stroke the golfer will find it helpful to combine each of the elements of properly aligning the golfer's line of sight over the target line, swinging the putter club face in line with the target line, and squaring the club face with the ball when the club face contacts the ball.

A number of devices exist for aiding a golfer in developing a more accurate and consistent putting stroke. However, many of these devices focus only on a single aspect of the putting stroke, typically in aiding the golfer in swinging the club face of the putter in line with the target line. As a result, these devices can actually hinder a golfer's putting ability by focusing on only one aspect of putting while ignoring others. In addition, many devices involve complicated designs that require sophisticated manufacturing or assembling techniques. Also, many devices are cumbersome and are not easily portable or compactable.

SUMMARY OF THE INVENTION

The present invention addresses the problems of the prior art by providing a putting aid that comprises a first and second attachment structure, an upper alignment member disposed between and attached to the attachment structures and a lower alignment member disposed between and attached to the attachment structures, such that the alignment members are vertically aligned to define a vertical plane which is perpendicular to a putting surface. The vertical plane determines a target line. In use, a golf ball is positioned on the putting surface such that a centerline of the golf ball is aligned with the vertical plane, and thus is also aligned with the target line. The golfer then aligns the golfer's line of sight with the vertical plane such that the upper alignment member obscures the lower alignment member. The golfer may then also align an aim line of a putter such that the alignment members obscure the aim line of the putter. The putting aid thus maintains both the alignment of the golfer's line of sight and the alignment of the aim line of the putter during a putting stroke.

DESCRIPTION OF THE DRAWINGS

These and other features and advantages of the present invention will be better understood by reference to the following detailed description when considered in conjunction with the accompanying drawings wherein.

DETAILED DESCRIPTION

The invention is directed to a putting aid for aiding a golfer in developing an accurate and consistent putting stroke. The putting aid comprises a first and a second attachment structure wherein upper and lower alignment members are disposed between and attached to the attachment structures, such that the alignment members are vertically aligned to define a vertical plane which is perpendicular to a putting surface. The vertical plane defines a target line, which is a path from the golf ball to a desired target. In use, the golfer positions a golf ball under a ball placement reference marker, which is slidably attached to the lower alignment member, such that the ball and the ball marker are concentric. In such a position, when the golfer obscures the lower alignment member with the upper alignment member, the golfer's line of sight will be in line with the target line. By obscuring an aim line of a putter club head by the alignment members, the club head is also positioned in line with the target line and the club face is positioned perpendicular to the target line. By maintaining the aim line of the club head obscured by the alignment members during the entire putting stroke, the putting stroke will follow the line of the putt and the club face will be positioned perpendicular to the target line, resulting in a putt that follows the target line.

Figure 1:
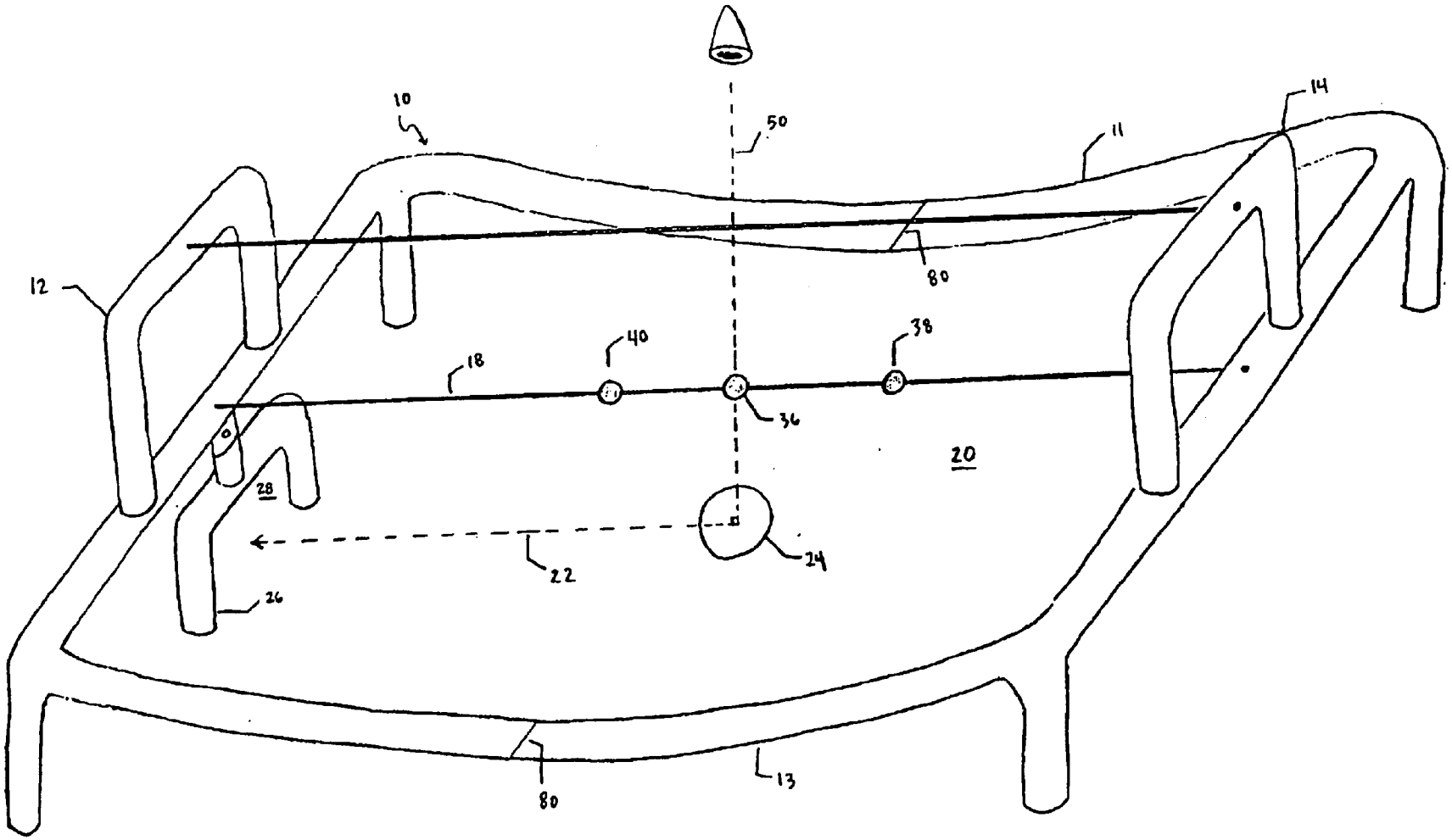
FIG. 1 is a perspective view of a putting aid according to the invention.

FIG. 1 shows a putting aid 10 having a first attachment structure 12 and a second attachment structure 14. A first and a second support 11 and 13 are disposed between and attached to the attachment structures 12 and 14, for horizontally supporting the attachment structures. Preferably, the supports 11 and 13 are fixedly attached to the attachment structures 12 and 14 such as by welding. Although other appropriate attachment means are also contemplated, including releasable attachments. In addition, the attachment structures 12 and 14 and the supports 11 and 13 may be made from a variety of materials such as metal, wood, plastic or another appropriate material. An upper alignment member 16 and a lower alignment member 18 are also disposed between the attachment structures 12 and 14. In a preferred embodiment, the alignment members 16 and 18 are elastic ropes, which are flexible and expandable. However, in other embodiments, the alignment members may comprise other flexible materials or rigid materials such as metal, wood or plastic. The supports may be telescoping, such that a distance between the attachment structures 12 and 14 can be adjusted. The alignment members 16 and 18 are attached to the attachment structures 12 and 14 such that the alignment members are vertically aligned to define a vertical plane which is perpendicular to a putting surface 20. The vertical plane defines a target line 22 which is a path from a golf ball 24 to a target 26 that, if followed, results in the ball passing through an opening 28 in the target, which is an indication of a successful putt. The putting aid 10 also includes a plurality of reference markers, such as a ball placement reference marker 36, a back swing reference marker 38 and a follow through reference marker 40, each of which is slidably attached to the lower alignment member 18. For example, each of the reference markers may be a bead or a ring, having a central lumen through which the lower alignment member 18 extends. Alternatively, any or all of the reference markers may be attached to the upper alignment member 16. In a preferred embodiment, the reference markers 36, 38 and 40 are beads having central lumens through which the lower alignment member 18 extends. The ball marker 36 acts as a guide for placing the ball 24 on the putting surface 20. The back swing and follow through markers 38 and 40 act as guides to aid the golfer in determining when to terminate a back swing of a putting stroke and when to terminate a follow through of a putting stroke, respectively.

When a golfer is prepared to start practicing a putting stroke, the golfer slides the ball marker 26 along the lower alignment member 18 until a desired distance from the target 26 to the ball 24 is obtained. The golfer can then adjust the back swing and follow through markers 38 and 40 according to the golfer's preference, although typically, the back swing and follow through of a proper putting stroke are equidistant from the ball 24 and vary in length depending on the distance from the ball and the target 26. After the reference beads 36, 38 and 40 are adjusted to desired positions, the golfer can use the ball marker 36 to guide the golfer in placing the ball 24 on the putting surface 20. When the golfer has positioned the ball 24 in a position on the putting surface 20 directly beneath the ball marker 36 such that a center point of the ball marker is concentric with the ball, a centerline of the ball 24 will be vertically aligned with the vertical plane defined by the alignment members 16 and 18, and thus the centerline of the ball will also vertically aligned with the target line 22. After the centerline of the ball 24 has been properly aligned with the target line 22, the golfer can use the alignment members 16 and 18 to aid the golfer in properly aligning the golfer's line of sight 50. When the golfer has adjusted the golfer's line of sight 50 such that the upper alignment member 16 obscures the lower alignment member 18, i.e. when the lower alignment member is hidden beneath the upper alignment member, the line of sight is vertically aligned with the target line 22. With the centerline of the ball 24 aligned with the target line 24 and the golfer's line of sight 50 vertically aligned with both the centerline of the ball and the target line, the golfer can next concentrate on forming a putting stroke which is in line with the target line 22.

Figure 2:
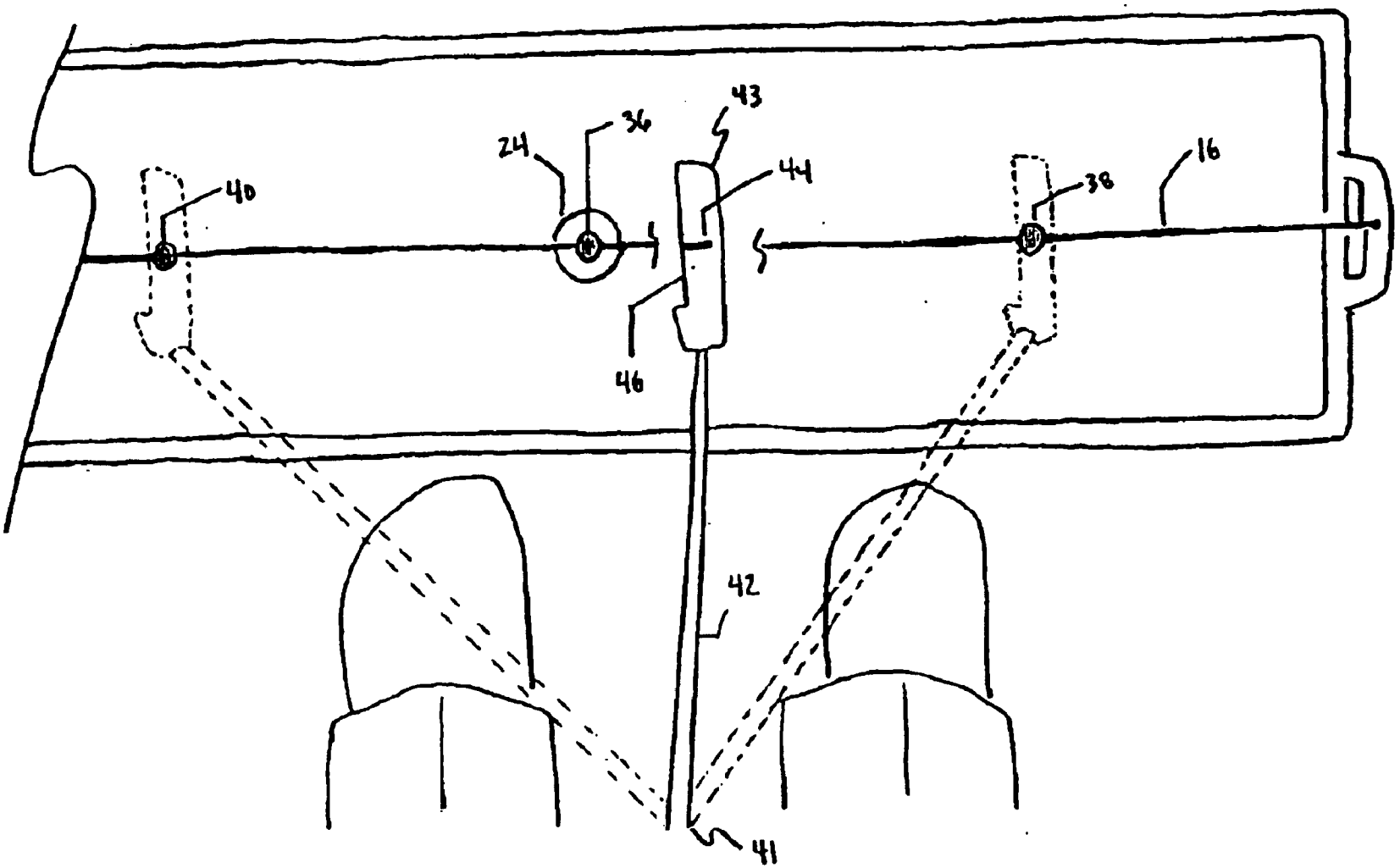
FIG. 2 is a top view of the putting aid of FIG. 1, wherein an upper alignment member is shown obscuring a lower alignment member.

FIG. 2 shows a typical putting club, commonly referred to as a putter, 41. The putter 41 has a shaft 42 and a club head 43. The club head 43 contains a club face 46, which is the intended contacting surface of the putter 41 and an aim line 44 that is perpendicular to the club face 46. After the golfer has properly aligned the centerline of the ball 24 with the target line 24 and properly aligned the golfer's line of sight 50 with both the centerline of the ball and the target line, the golfer can use the alignment members 16 and 18 to aid the golfer in properly aligning the golfer's putting stroke with the target line 22. When the golfer has adjusted the aim line 44 of the putter 41 such that the alignment members 16 and 18 obscure the aim line, i.e. when the aim line is hidden beneath the alignment members, the aim line 44 and therefore the club head 43 is in line with the target line. In addition, since the aim line 44 is in line with the target line 22, which, in turn, is in line with the centerline of the ball 24, and since the aim line 44 is perpendicular to the club face 46, when the alignment members 16 and 18 obscure the aim line 44 of the putter 41, the club face is perpendicular to the centerline of the ball 24. Having a club face perpendicularly aligned with respect to the center line of a ball is commonly referred to as having a club face that is square to the ball. When the golfer obscures the aim line 44 by the alignment members 16 and 18 during the entire putting stroke, from back swing, to front swing, to ball impact, to follow through, the putter aim line 44 will remain in line with the target line 22 and the putter club face 46 will remain square to the ball during the entire putting stroke, and, as a result, after being struck, the ball 24 will follow the target line 22 and pass through the opening 28 in the target 26, thus indicating that a successful putt has been made.

The putting aid has an assembled position, as described above, and a collapsed position that allows the putting aid to occupy less space. When it is desired to store the putting aid, the aid can be transformed from the assembled position to the collapsed position by rotating the supports 11 and 13 about hinges 80. Preferably, the hinges 80 are oriented such that the rotation is directed away from the alignment members. It is also preferred that the supports 11 and 13 are bowed downwardly, towards the putting surface, such that at least a portion of the supports are disposed below the lower alignment member 18. Bowing the supports 11 and 13 downwardly makes it less likely that the supports will inadvertently rotate into the collapsed position when the putting aid is set up in the assembled position.

Also, although an embodiment wherein the supports are straight is also contemplated by the invention, having straight supports 11 and 13 creates an arrangement wherein the supports and alignment members 16 and 18 are all parallel, making it difficult to focus the golfer's eyes on any one of the parallel structures. Bowing the supports 11 and 13 aids the golfer in visually focusing on the alignment members 16 and 18. Having bowed supports 11 and 13 such that at least a portion of the supports are disposed lower than the lower alignment member 18, also aids the golfer in inserting the putter head 43 between the support and the lower alignment member 16 such that the putter head 43 can be positioned beneath the alignment members 16 and 18 when the golfer is ready to practice putting.

As previously discussed, the back swing marker 38 acts as a guide to aid the golfer in determining when to terminate a back swing and thus when to begin the front swing, and the follow through marker 40 acts as a guide to aid the golfer in determining when to terminate the follow through. The back swing and follow through markers 38 and 40 can be utilized by the golfer according to the golfer's preference. For example, the golfer may terminate the back swing and the follow through at a position directly before the markers 38 and 40 begin to obscure the club head 43, when the markers obscure a midpoint of the club head, or any other way in which the golfer desires to utilize the markers.

Figure 3:
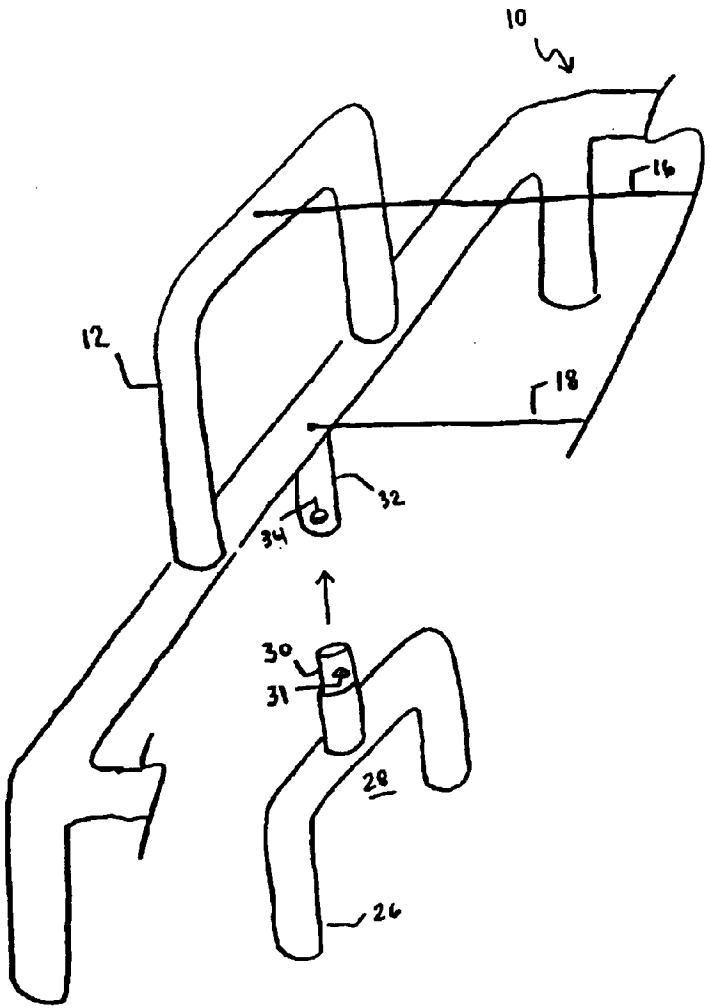
FIG. 3 is a perspective view of a portion of the putting aid of FIG. 1, showing a releasable connection between a putting aid attachment structure and a putting target.

As shown in FIGS. 1 and 3, the target 26 is attached to the first attachment structure 12. Preferably, the target 26 is attached to the first attachment structure 12 such that the target opening 28 is bisected by the vertical plane defined by the alignment members 16 and 18. In such an instance, the target line 22 will be in line with a centerline of the target opening 28 and the success of the putt can be determined by whether or not the ball 24 passes through the target opening 28. The opening 28 may be of a variety of shapes and sizes, but preferably is at least as large as a regulation size golf ball, which is a sphere having a 1 11/16 inch diameter. The target 26 may be releasably attached to the first attachment structure 12, such that it may be detached from the first attachment structure and replaced with other targets (not shown), which have openings of different sizes. For example, for a challenging putt, an advanced golfer may wish to attach a target having an opening that is only slightly larger than the 1 11/16 inch diameter of the regulation size golf ball, or for a less challenging putt, a novice may wish to attach a target having an opening that is even larger than the 4¼ inch diameter of a regulation size golf cup. Alternatively, the target 26 may be constructed without an opening 28, in which case the success of the putt can be determined by whether of not the ball contacts the target 26.

FIG. 3 shows a means for releasably attaching the target to the first attachment structure 12. In the depicted embodiment, the target 26 has a protruding member 30 having a compression pin 31, which extends from an outer surface of the protruding member, but may be compressed into a flush position with respect to the outer surface of the protruding member. The protruding member 30 mates with an protruding section 32 of the first attachment structure 12, which has an opening 34 that mates with the compression pin 31 to releasably secure the target 26 to the first attachment structure when the compression pin is disposed within the opening of the protruding section. Although a compression pin mating with an opening has been described, a number of other releasable attachments may be used, such as screw fastening, press fitting, or any other appropriate releasable attachment means. Alternatively, the target 26 can be affixed to the first attachment structure 12 by welding, gluing, or another appropriate affixing means. In addition, although not shown, a target can also be attached to the second attachment structure 14, such that the putting aid has a target attached to each attachment structure 12 and 14.

Figure 4:
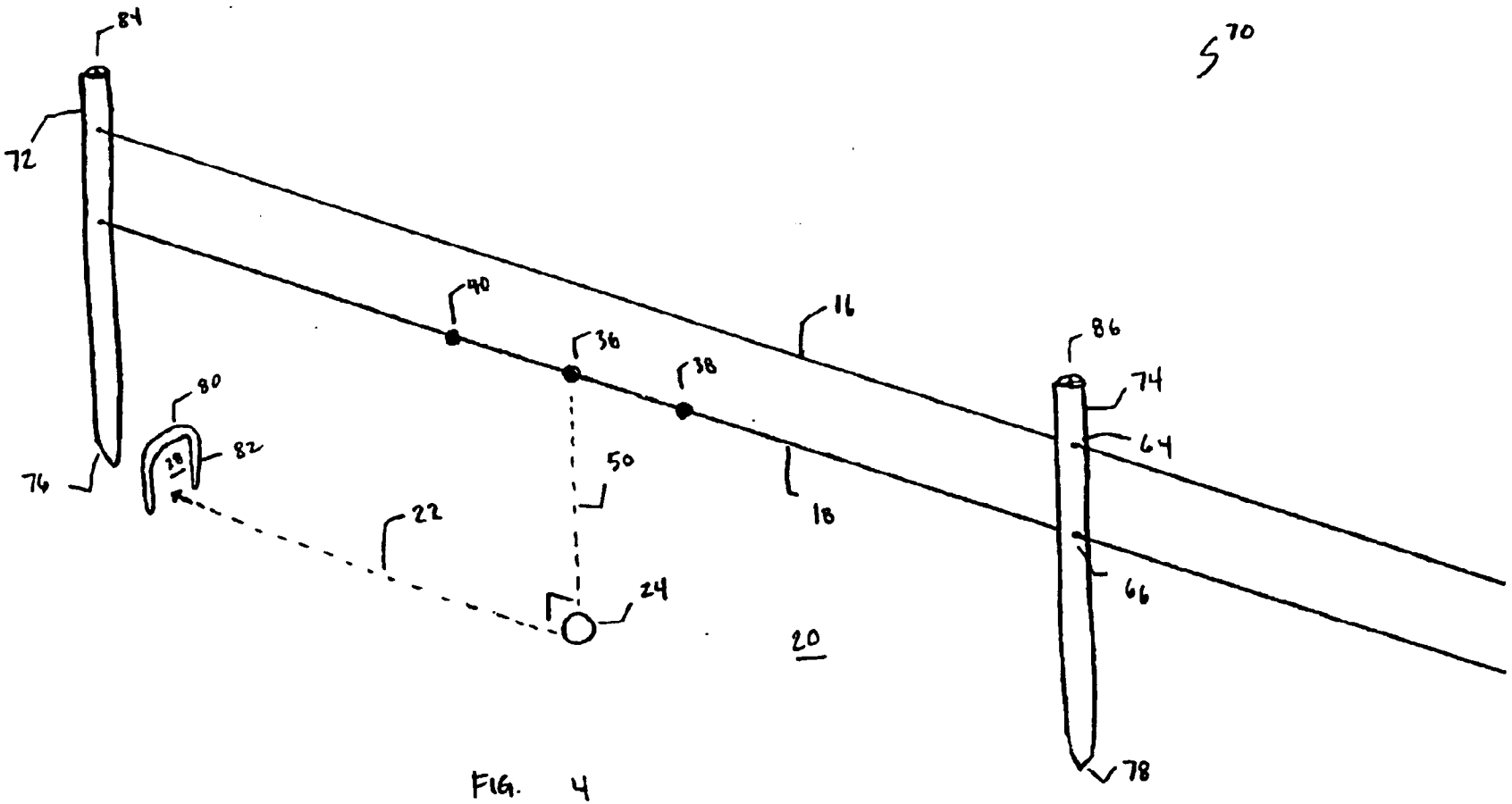
FIG. 4 is a perspective view of another alternative embodiment of a putting aid according to the invention.

FIG. 4 shows an alternative embodiment of a putting aid according to the invention. The depicted embodiment shows a putting aid 70 having a first attachment structure, such as a first endpost 72 and a second attachment structure, such as a second endpost 74. The endposts 72 and 74 have spiked ends 76 and 78, respectively, such that the endposts may be embedded into the putting surface 20. The upper ends of the endposts 76 and 78 may have built in circular levels 84 and 86, respectively, to aid the golfer in embedding the endposts perpendicularly to the ground. An upper alignment member 16 and a lower alignment member 18 are disposed between the endposts 72 and 74. In a preferred embodiment, the alignment members 16 and 18 are elastic ropes, which are flexible and expandable. However, in other embodiments, the alignment members may comprise other flexible materials or rigid materials such as metal, wood or plastic. The alignment members 16 and 18 are attached to the endposts 72 and 74 such that the alignment members are vertically aligned to define a vertical plane which is perpendicular to a putting surface 20. The vertical plane defines a target line 22 which is a path from a golf ball 24 to a target 80 that, if followed, results in the ball passing through an opening 28 in the target, which is an indication of a successful putt. The target 80 has spiked lower ends 82 such that the target may be embedded into the putting surface 20. The target 80 should be embedded into the putting surface 20, such that the target line bisects the opening 28 of the target. Alternatively, the first endpost 72 itself can function as a target. In still another alternative, the first endpost 72 may be inserted into a golf cup (not shown) and the second endpost 72 may be embedded into the putting surface 20, in which case, the cup functions as the target.

The putting aid 70 also includes a plurality of reference markers, such as a ball placement reference marker 36, a back swing reference marker 38 and a follow through reference marker 40, each of which is slidably attached to the lower alignment member 18. Alternatively, any or all of the reference markers may be attached to the upper alignment member 16. In a preferred embodiment, the reference markers 36, 38 and 40 are beads having central lumens through which the lower alignment member 18 extends. The ball marker 36 acts as a guide for placing the ball 24 on the putting surface 20. The back swing and follow through markers 38 and 40 act as guides to aid the golfer in determining when to terminate a back swing of a putting stroke and when to terminate a follow through of a putting stroke, respectively.

When a golfer is prepared to start practicing a putting stroke, the golfer can use the ball marker 36 to guide the golfer in placing the ball 24 on the putting surface 20. When the golfer has positioned the ball 24 in a position on the putting surface 20 directly beneath the ball marker 36 such that a center point of the ball marker is concentric with the ball, a centerline of the ball 24 will be vertically aligned with the vertical plane defined by the alignment members 16 and 18, and thus the centerline of the ball will also vertically aligned with the target line 22. After the centerline of the ball 24 has been properly aligned with the target line 22, the golfer can use the alignment members 16 and 18 to aid the golfer in properly aligning the golfer's line of sight 50. When the golfer has adjusted the golfer's line of sight 50 such that the upper alignment member 16 obscures the lower alignment member 18, the line of sight is vertically aligned with the target line 22. After the golfer has properly aligned the centerline of the ball 24 with the target line 24 and properly aligned the golfer's line of sight 50 with both the centerline of the ball and the target line, the golfer can use the alignment members 16 and 18 to aid the golfer in properly aligning the golfer's putting stroke with the target line 22. When the golfer has adjusted the aim line 44 of the putter 41 such that the alignment members 16 and 18 obscure the aim line, the aim line 44 and therefore the club head 43 is in line with the target line. In addition, since the aim line 44 is in line with the target line 22, which, in turn, is in line with the centerline of the ball 24, and since the aim line 44 is perpendicular to the club face 46, when the alignment members 16 and 18 obscure the aim line 44 of the putter 41, the club face is perpendicular to the centerline of the ball 24. Having a club face perpendicularly aligned with respect to the center line of a ball is commonly referred to as having a club face that is square to the ball. When the golfer obscures the aim line 44 by the alignment members 16 and 18 during the entire putting stroke, from back swing, to front swing, to ball impact, to follow through, the putter aim line 44 will remain in line with the target line 22 and the putter club face 46 will remain square to the ball during the entire putting stroke, and, as a result, after being struck, the ball 24 will follow the target line 22 and pass through the opening 28 in the target 80, thus indicating that a successful putt has been made.

The putting device 70 of the embodiment depicted in FIG. 4 is adjustable in the longitudinal direction, such that putts of varying lengths may be practiced. In one embodiment, the alignment members 16 and 18 are affixed to the attachment endposts 72 and 74 but comprise an elastic material capable of producing a longitudinal contraction or expansion corresponding to the longitudinal adjusting of a distance between the endposts. In another embodiment, the alignment members 16 and 18 are affixed to the first endpost 72 but extend through openings 64 and 66, respectively, in the second endpost 74. As a result, a longitudinal adjustment of the distance between the endposts 72 and 74 creates a corresponding relative movement between the alignment members 16 and 18 and the openings 64 and 66. The alignment members 16 and 18 should be comprised of a rigid enough material such that the longitudinal adjustments do not produce slack in the alignment members. However, if the material of the alignment members is not sufficiently rigid, clips can be attached to the alignment members in close proximity to the openings 64 and 66 such that slack can be prevented in the alignment members 16 and 18. When it is desired to store the putting aid, the endposts 72 and 74, as well as the target 82 can be brought together in close proximity such that the putting aid occupies less space.

The preceding description has been presented with reference to presently preferred embodiments of the invention. Workers skilled in the art and technology to which this invention pertains will appreciate that alterations and changes in the described structure may be practiced without meaningfully departing from the principal, spirit and scope of this invention.

Accordingly, the foregoing description should not be read as pertaining only to the precise structures described and illustrated in the accompanying drawings, but rather should be read consistent with and as support to the following claims which are to have their fullest and fair scope.

What is claimed is:

1. A golf putting aid comprising:

first and second attachment structures;

an upper alignment member disposed between and attached to the attachment structures;

a lower alignment member disposed between and attached to the attachment structures, such that the alignment members are vertically aligned to define a vertical plane which is perpendicular to a putting surface;

at least one longitudinal support member disposed between and fixedly attached to the attachment structures; and a target removably attached to the first attachment structure, wherein the target has an opening which is centered with respect to the vertical plane, and wherein the opening is at least as large as a regulation size golf ball.

2. The golf putting aid of claim 1, wherein the alignment members are flexible.

3. The golf putting aid of claim 1, wherein the alignment members are non-adjustable in the vertical plane which is perpendicular to the putting surface.

4. The golf putting aid of claim 1, wherein the at least one longitudinal support member is compactable such that when it is desired to store the putting aid, the putting aid occupies less space.

5. The golf putting aid of claim 4, wherein the at least one longitudinal support member contains a hinge such that when it is desired to store the putting aid, the at least one longitudinal support member rotates about the hinge, such that the putting aid occupies less space.

6. The golf putting aid of claim 5, wherein the alignment members are flexible such that when the at least one longitudinal support member is compacted, the alignment members are compacted.

7. A golf putting aid comprising:

first and second attachment structures;

an upper alignment member disposed between and attached to the attachment structures;

a lower alignment member disposed between and attached to the attachment structures, such that the alignment members are vertically aligned to define a vertical plane which is perpendicular to a putting surface; and at least one longitudinal support member disposed between and fixedly attached to the attachment structures, wherein the at least one longitudinal support member is bowed downwardly towards the putting surface.

8. The golf putting aid of claim 7, wherein at least a portion of the longitudinal support member is disposed lower than the lower alignment member.

9. A golf putting aid comprising:

first and second attachment structures;

an upper alignment member attached to the attachment structures;

a lower alignment member attached to the attachment structures such that the alignment members are vertically aligned to define a vertical plane which is perpendicular to a putting surface;

a support frame attached to the attachment structures, wherein the support frame comprises at least one longitudinal support member disposed between and fixedly attached to the attachment structures; and a target removably attached to the first attachment structure, wherein the target has an opening which is centered with respect to the vertical plane, and wherein the opening is at least as large as a regulation size golf ball.

10. The golf putting aid of claim 9, wherein the alignment members are flexible.

11. The golf putting aid of claim 9, wherein the alignment members are non-adjustable in the vertical plane which is perpendicular to the putting surface.

12. The golf putting aid of claim 9, wherein the at least one longitudinal support member is compactable such that when it is desired to store the putting aid, the putting aid occupies less space.

13. The golf putting aid of claim 12, wherein the at least one longitudinal support member contains a hinge such that when it is desired to store the putting aid, the at least one longitudinal support member rotates about the hinge, such that the putting aid occupies less space.

14. The golf putting aid of claim 13, wherein the alignment members are flexible such that when the at least one longitudinal support member is compacted, the alignment members are compacted.

15. The golf putting aid of claim 9, wherein the support frame is substantially rectangular shaped.

16. The golf putting aid of claim 15, wherein the support frame comprises:

a first lateral support connected to the first attachment structure;

a second lateral support connected to the second attachment structure;

a first longitudinal support disposed between and connected to the first and second lateral supports; and a second longitudinal support disposed between and connected to the first and second lateral supports.

17. The golf putting aid of claim 16, wherein the first and second longitudinal support members each contains a hinge such that when it is desired to store the putting aid, each longitudinal support member rotates about its corresponding hinge, allowing the putting aid to occupy less space.

18. A golf putting aid comprising:

first and second attachment structures;

an upper alignment member attached to the attachment structures;

a lower alignment member attached to the attachment structures such that the alignment members are vertically aligned to define a vertical plane which is perpendicular to a putting surface; and a support frame attached to the attachment structures, wherein the support frame comprises at least one longitudinal support member disposed between and fixedly attached to the attachment structures, wherein the at least one longitudinal support member is bowed downwardly towards the putting surface.

19. The golf putting aid of claim 18, wherein at least a portion of the longitudinal support member is disposed lower than the lower alignment member.

* * * * *